United States Patent [19]

Hotten

[11] 3,992,307

[45] Nov. 16, 1976

[54] LUBRICANT COMPOSITION OF IMPROVED ANTIOXIDANT PROPERTIES

[75] Inventor: Bruce W. Hotten, Orinda, Calif.

[73] Assignee: Chevron Research Company, San Francisco, Calif.

[22] Filed: Nov. 4, 1974

[21] Appl. No.: 520,820

[52] U.S. Cl. ..... 252/46.7; 252/49.9; 252/400 A

[51] Int. Cl.[2] ..... C10M 1/48

[58] Field of Search ..... 252/46.7, 49.9, 400 A

[56] References Cited

UNITED STATES PATENTS

| | | | |
|---|---|---|---|
| 3,429,813 | 2/1969 | Waight et al. | 252/46.7 |
| 3,537,998 | 11/1970 | Lowe | 252/46.7 |
| 3,795,613 | 3/1974 | Hotten | 252/46.7 X |
| 3,810,838 | 5/1974 | Haugen | 252/46.7 |
| 3,859,219 | 1/1975 | Hotten | 252/46.7 |
| 3,868,376 | 2/1975 | Hotten | 252/46.7 X |
| 3,903,002 | 9/1975 | Hotten | 252/49.9 |

OTHER PUBLICATIONS

Kalichevsky et al., "Petroleum Refining with Chemicals", 1956, pp. 590–610.

*Primary Examiner*—Delbert E. Gantz
*Assistant Examiner*—Andrew H. Metz
*Attorney, Agent, or Firm*—G. F. Magdeburger; C. J. Tonkin; L. L. Priest

[57] ABSTRACT

A lubricating composition is disclosed having improved multifunctional properties and comprises a major amount of an oil of lubricating viscosity and minor amounts of (I) an oil-soluble anti-oxidant selected from sterically hindered phenolic and thiophenolic compounds, aromatic amines and sulfurized organic compounds and (II) a bisphosphoramide formed by reacting (1) phosphorus oxychloride with (2) a polyamine having from 2 to 7 amine nitrogens, from 2 to 20 carbons and having at least 1 primary amino group, and (3) a monoamine having from 1 to 40 carbons.

11 Claims, No Drawings

LUBRICANT COMPOSITION OF IMPROVED ANTIOXIDANT PROPERTIES

BACKGROUND OF THE INVENTION

This invention relates to an improved lubricating composition. More particularly, this invention relates to a lubricating composition having improved anti-oxidation and anti-wear properties.

It is highly advantageous to compound a lubricating oil so that it exhibits good anti-wear properties while at the same time having the ability to withstand oxidation over prolonged periods. The employment of anti-wear agents in lubricating oils, such as engine oils, transmission fluids, hydraulic fluids, etc., is well established. Numerous types of additives have been developed and several have proved quite successful in reducing wear and increasing equipment life. The conventional anti-wear agents which have experienced commercial success include the zinc dihydrocarbyl dithiophosphates, the zinc dialkyl dithiocarbamates, tricresyl phosphate, dilauryl phosphate, dialkyl phosphite, sulfurized terpenes, sulfurized sperm oil, various chlorinated compounds, etc. Of the above compounds, the zinc dihydrocarbyl dithiophosphates have essentially dominated the field.

While the conventional anti-wear agents have performed satisfactorily in the older equipment, the introduction of more powerful and high-speed machines has encouraged the development of anti-wear agents capable of imparting sustained anti-wear properties under elevated temperature conditions. The employment of zinc dihydrocarbyl dithiophosphates or other metal-containing anti-wear agents has not been entirely successful in these engines, since such agents are burdened with a high ash content. Some of the problems with the nonmetal-containing agents include the diminution of raw materials employed to produce some of the additives, i.e., reduction of availability of sperm whale oil, etc.

Thus, there has been a need for the development of an anti-wear agent having good anti-wear properties and not having a high ash content and that is relatively inexpensive to make.

In addition to the anti-wear properties, it is an important feature that the anti-wear agents be stable under an oxidizing environment. For example, the internal combustion engine is a model oxidator since it contacts a hydrocarbon motor oil with air under agitation and at high temperatures. Moreover, many of the metals manufactured into the engine and in contact with both the oil and air are excellent oxidation catalysts and effectively increase the rate of oxidation. The oxidation produces acidic bodies within the motor oil which are corrosive to typical bearings and additionally contributes to piston ring sticking, formation of sludges within the motor oil and over-all breakdown of the viscosity characteristics of the lubricant.

Several effective additives have been developed for imparting anti-oxidation properties to a lubricant. Their employment has been utilized in almost all of the conventional motor oils today. Typical of these inhibitors are the phenolic and thiophenolic anti-oxidants, such as the sterically hindered phenols and thiophenols, hindered hydroxy or thiolbenzoic acid esters, etc., aromatic amine anti-oxidants, such as alkylated phenyl amines, alkylphenyl-formaldehyde-amine polycondensates, etc., and the sulfurized oil-soluble organic compounds such as the sulfurized esters, sulfurized olefins, etc. Although these additives exhibit good anti-oxidation properties, many are often burdened with high costs when employed at the concentration necessary to impart the proper degree of oxidation inhibition, and others simply do not provide the desired degree of oxidation inhibition. Thus a need exists for an improved anti-oxidant that is stable at elevated temperatures, that can be employed at reduced concentrations, that is economical and relatively easy to produce and that can be used in combination with an anti-wear agent.

It is therefore an object of this invention to provide an improved lubricating composition.

It is an additional object of this invention to provide a lubricant composition having improved anti-oxidation properties. It is an additional object of this invention to provide a lubricant having improved anti-wear and anti-oxidation properties. Other additional objects will become apparent from the following description of the invention and the accompanying claims.

SUMMARY OF THE INVENTION

The aforegoing objects and their attendant advantages can be realized by incorporating into a major portion of an oil of lubricating viscosity minor amounts of (I) an oil-soluble anti-oxidant selected from (i) sterically hindered phenolic and thiophenolic compounds having from 10 to 40 carbons, (ii) aromatic amines having from 12 to 40 carbons and from 1 to 3 amine nitrogens, (iii) sulfurized organic compounds containing 3 to 40 weight percent sulfur present as thio or polythio linkages or mixtures thereof, or (iv) mixtures thereof, and (II) a bisphosphoramide prepared by reacting (1) phosphorus oxychloride, (2) a polyamine having from 2 to 7 amine nitrogens, from 2 to 20 carbons and having at least 1 primary amino group and (3) a primary or secondary monoamine having from 1 to 40 carbons.

I have discovered that the anti-oxidation and the anti-wear properties of a lubricant containing a conventional (a) phenolic or thiophenolic, (b) aromatic amine, or (c) sulfurized organic anti-oxidant can be increased by the addition of a bisphosphoramide activator. Although the exact mechanisms of the bisphosphoramide in significantly activating the anti-oxidation of the conventional anti-oxidant and in imparting anti-wear properties to the system are unknown, I have found that the two components complement each other in a synergistic manner, resulting in a combination having properties superior to either additive alone. With the instant combination, the amount of anti-oxidant necessary in order to impart the desired anti-oxidation properties to the lubricating oil, functional fluid, or industrial oil blend is significantly less than that amount needed when the bisphosphoramide component is not present. The bisphosphoramide has no measurable anti-oxidation activity by itself.

DETAILED DESCRIPTION OF THE INVENTION

Compositions of this invention are highly stable lubricants and exhibit excellent oxidation stability and display good anti-wear properties. These lubricants are quite useful in motor oils for internal combustion engines, particularly in gasoline engines operated under elevated temperature conditions and for gear oils and industrial lubricants. These lubricants may also be used in rotary engines, transmission fluids, hydraulic systems, turbines, etc. The lubricant composition of this invention having improved anti-oxidation and anti-wear properties comprises: (I) from 85 to 98 parts by weight (preferably 88 to 95 parts by weight) of a stable organic oil of lubricating viscosity; (II) from 0.05 to 10 parts by weight (preferably from 0.1 to 5 parts by weight) of an oil-soluble anti-oxidant selected from (i) sterically hindered phenolic and thiophenolic compounds having from 10 to 40 carbons (preferably from 15 to 32 carbons), (ii) aromatic amine compounds having from 12 to 40 carbons and from 1 to 3 amine nitrogens, and preferably 12 to 32 carbons and 1 to 2 amine nitrogens, (iii) sulfurized organic compounds containing 3 to 40 weight percent (preferably 5 to 20 weight percent) sulfur present as thio or polythio linkages or mixtures thereof, or (iv) mixtures thereof; and (III) from 0.05 to 5 parts by weight (preferably from 0.1 to 3 weight parts) of a bisphosphoramide prepared by reacting (1) phosphorus oxychloride, (2) a polyamine having from 2 to 7 amine nitrogens, from 2 to 20 carbons and having at least 1 primary amino group, and (3) a monoamine having from 1 to 40 carbons. The ratio of the anti-oxidant component to the bisphosphoramide normally varies from 0.1 to 20:1 and preferably from 1 to 10:1.

ANTI-OXIDANT COMPONENTS

The class of anti-oxidants which may be employed in the practice of this invention include oil-soluble phenolic and thiophenolic anti-oxidants, oil-soluble aromatic amine anti-oxidants, and oil-soluble sulfurized organic compounds containing from 3 to 40 percent by weight of sulfur which is present as thio or polythio linkages, or mixtures thereof.

Included within the definition of phenolic and thiophenolic anti-oxidants are sterically hindered phenols and bisphenols, hindered thiophenols and bis(thiophenols), hindered 4,4'-thiobis-phenols, hindered 4-hydroxy- and 4-mercaptobenzoic acid esters and ditho esters, and hindered bis(4-hydroxy- and 4-mercaptobenzoic acid and dithio acid) alkylene esters. The sterically hindered phenols and benzoic acid esters are the preferred phenolic anti-oxidants.

The sterically hindered phenolics and thiophenolics have the basic general structure

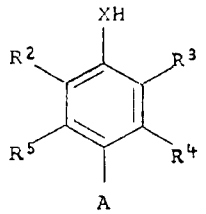

wherein X is sulfur or oxygen, and preferably oxygen; $R^2$ and $R^3$ are alkyl groups which sterically hinder the XH group and preferably have from 4 to 10 carbons and usually branched chains; $R^4$ and $R^5$ are the same or different substituent selected from hydrogen or a $C_1$–$C_4$ alkyl, preferably hydrogen; and A is defined infra.

The phenolic moiety is substituted in both positions ortho to the hydroxy or thiol groups with alkyl groups which sterically hinder these groups. Such alkyl substituents usually have 3 to 10 carbons and one generally branched rather than straight chain, e.g., t-butyl, t-amyl, and the like.

The first group of hindered phenolic and thiophenolic anti-oxidants are the single hindered phenols and thiophenols, i.e., where A in the above formula is hydrogen or a $C_1$ to $C_{10}$ alkyl group. Examples of such compounds include 2,6-di-t-butylphenol, 2,6-di-t-butyl-p-cresol, 2,6-di-t-amyl-p-cresol; 2-t-butyl-6-t-amyl-p-cresol, 2,6-di(t-butyl)thiophenol, 2-t-butyl-6-amyl-thiophenol, etc. Trialkylated monohydroxy phenols which may be employed herein are disclosed in U.S. Pat. No. 2,265,582.

A second group of hindered phenolic and thiophenolic anti-oxidants is the hindered bis-phenols and bis-thiophenols. In this case, A is a bond to another basic phenolic or thiophenolic group, preferably through a $C_1$ to $C_4$ alkylene group. Examples of these compounds include 4,4'-methylene bis(2,6-di-t-butylphenol), 4,4'-dimethylene bis(2,6-di-t-butylphenol), 4,4'-trimethylene bis(2,2-di-t-amyl phenol), 4,4'-trimethylene bis(2,6-di-t-butylphenol), 4,4'-methylene bis(2,6-di-t-butylthiophenol), etc.

Another group of hindered phenolic and thiophenolic anti-oxidants is the hindered 4,4'-thio bisphenols, i.e., where A in the formula is sulfur connected to another phenol or thiophenol group. Examples of these compounds include 4,4'-thio bis(2,6-di-t-butylphenol), 4,4'-thio bis(2,6-di-secbutylphenol), 4,4'-thio bis(2-t-butyl-6-isopropylphenol), 4,4'-thio bis(2-methyl-6-t-butylphenol), etc. These compounds and their preparations are described in detail in U.S. Pat. No. 3,326,800, which is herein incorporated by reference.

A fourth group of hindered phenolic and thiophenolic anti-oxidants are 4-hydroxy- and 4-mercaptomonothio- or dithiobenzoic acid esters, i.e., A in the above formula is a $C_2$–$C_{21}$ ester or a dithio ester group. Exemplary compounds of this group include 3,5-di-t-butyl-4-hydroxybenzoic acid methyl ester, 3,5-di-t-butyl-4-hydroxydithiobenzoic acid methyl ester, 3,5-di-t-butyl-4-hydroxybenzoic acid n-octyl ester, 3,5-di-t-butyl-4-mercaptodithiobenzoic acid n-octyl ester, 3,5-di-t-butyl-4-hydroxydithiobenzoic acid hydroxypropyleneoxypropylene ester, etc.

Another group of hindered phenolic and thiophenolic anti-oxidants is bis(4-hydroxy- or 4-mercaptobenzoic acid or dithiobenzoic acid) alkylene esters, i.e., A in the above formula is a $C_2$–$C_{21}$ diester or dithio ester connected through an alkylene linkage to another phenolic group. Exemplary compounds of this type include bis(3,5-di-t-butyl-4-hydroxydithiobenzoic acid) methylene ester, bis(3,5-di-t-butyl-4-hydroxydithiobenzoic acid) ethylene ester, etc. The preparation of these compounds is the same as set forth above, except that the monohalohydrocarbon is replaced with a dihalohydrocarbon.

Included within the definition of oil-soluble aromatic amine anti-oxidants are aminophenols, naphthylphenylamines, phenylalkylamines, etc. The preferred aromatic amines have the basic group

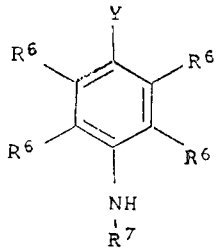

wherein Y is the same or different substituent selected from OH, SH, H, $R^6$, $NHR^6$or $NHR^7$; $R^6$ is the same or different substituent selected from H or a $C_1$ to $C_6$ alkyl; and $R^7$ is hydrogen or a $C_1$ to $C_{18}$ alkyl.

Examples of aromatic amine anti-oxidants included within the above formula include the hydroxyl and thiol amines, such as N-n-butyl-p-aminophenol, N-ethyl-sec-butyl-p-aminophenol, N-n-butyl-p-aminothiophenol, N-n-butyl-p-amino-2-methylphenol; phenylenediamines such as N,N'-di-secbutylphenylenediamine, N,N'-bis(1,4-dimethylpentyl)-p-phenylenediamine, N,N'-diphenyl-p-phenylenediamine, N,N'-di-p-naphthyl-p-phenylenediamine, N,N'-methylethyl-p-phenylenediamine, N,N'-di-n-butyl-p-phenylenediamine, etc.; the naphthylamines such as N-phenyl-alpha-naphthylamine, N-phenyl-beta-naphthylamine, N-p-methylphenyl-alpha-naphthylamine, etc.; and the diphenylamines such as di-sec-butyldiphenylamine, diisobornyldiphenylamine, and dioctyldiphenylamine.

These anti-oxidants can be prepared by known processes and many of them are commercially available. Because these processes are well known in the art, a description thereof is not necessary.

The sulfurized organic anti-oxidants which may be employed in the practice of this invention include a wide range of organic compounds containing from 3 to 40 weight percent (preferably 5 to 20 weight percent) sulfur which is present within the compound as thioethers or polythioethers. Sulfur in other forms, such as, sulfonates, sulfates, etc., may exist within the compound but is not included in the calculation of the sulfur content of the sulfurized organic compound. The compound may contain minor amounts of elements other than carbon, hydrogen and sulfur without adversely affecting properties of the composition and include elements such as oxygen, which may be present as ethers, ketones, carboxyls, esters, alcohols, etc; phosphorus; nitrogen present as amines, amides, imides, etc.; as well as metals such as alkali metals, alkaline earth metals, etc.

One class of sulfurized compounds which may be employed herein comprises sulfurized fatty esters. These compounds are prepared by contacting sulfur with an unsaturated fatty ester under elevated temperatures. Typical esters include $C_1$ to $C_{20}$ alkyl esters of $C_8$–$C_{24}$ unsaturated fatty acids, such as palmitoleic, oleic, ricinoleic, petroselinic, vaccenic, linoleic, linolenic, oleostearic, licanic, parinaric, tariric, gadoleic, arachidonic, cetoleic, erucic, nervonic, etc. Particularly good results have been obtained with mixed unsaturated fatty acid esters such are obtained from animal fats and vegetable oils such as tall oil, linseed oil, olive oil, castor oil, peanut oil, rape oil, fish oil, sperm oil, etc.

Exemplary fatty esters include lauryl tallate, methyl oleate, ethyl oleate, lauryl oleate, cetyl oleate, cetyl linoleate, lauryl ricinoleate etc.

These compounds can be phosphosulfurized by contacting the fatty esters with phosphorus pentasulfide along with the sulfur to produce a sulfurized-phosphosulfurized ester. They may be further reacted with a $C_3$ to $C_6$ alkylene polyamine having from 2 to 5 nitrogens to impart varnish-inhibiting properties to the lubricant.

Another class of sulfurized compound which may be employed in the practice of this invention includes sulfurized terpenes, such as sulfurized pine oil, sulfurized terpinolene, sulfurized dipentene, sulfurized pinene, etc.

Sulfurized olefins such as $C_8$ to $C_{30}$ mono- and polyethylenically unsaturated aliphatic hydrocarbons inclusive of sulfurized paraffin waxes, etc., may also be employed. Aromatic and alkyl sulfides may be employed, such as dibenzyl sulfide, dixylyl disulfide, dicetyl sulfide, etc.

Another type of sulfurized compound which may be employed is amido-substituted dithiazole-thiones. These compounds are believed to have the general structural formula:

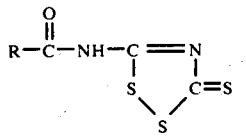

wherein R is a hydrocarbyl having from 8 to 24 carbons. Hydrocarbyl as defined herein is a monovalent organic radical composed essentially of hydrogen and carbon and may be aliphatic, aromatic, or alicyclic or combinations thereof, and may be saturated or unsaturated. The preferred hydrocarbyl is an alkyl.

The amido-substituted dithiazole compounds may be prepared by reacting dithiazole-thione with a hydrocarbonyl chloride (RCOCl) in the presence of an inert reaction solvent at moderate reaction conditions.

Another class of sulfurized compounds include $C_{10}$ to $C_{30}$ sulfurized hydroxyesters. These compounds are prepared by reacting a fatty acid of the type mentioned supra with a $C_4$ to $C_{20}$ aliphatic epoxide and then contacting the reaction product with sulfur under elevated temperatures and pressures.

Another class of sulfurized compounds which may be advantageously employed in the practice of this invention comprise the polyalkylphenol sulfides. These compounds have the general structural formula:

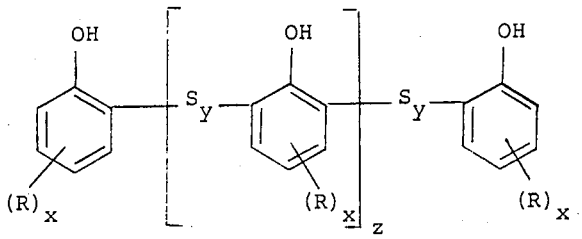

wherein R is an alkyl having from 5 to 24 carbons; $x$ is an integer from 1 to 3; $y$ is an integer from 1 to 5; and $z$ is an integer from 0 to 5.

Compounds having the above formula are prepared by contacting an alkylated phenol with sulfur mono- or dichloride in the proper portions under elevated temperatures. These compounds can be thereafter reacted with phosphorus pentoxide, an alkali or alkaline earth metal base or an amine.

A particularly useful sulfurized compound because of its multifunctional properties is a sulfurized metal phenate. These compounds are prepared by reacting an alkylphenol with sulfur and an alkaline earth metal base (e.g., calcium hydroxide, barium hydroxide, calcium oxide, etc.) in the presence of a mutual solvent. The resulting compounds have a generalized structural formula as follows:

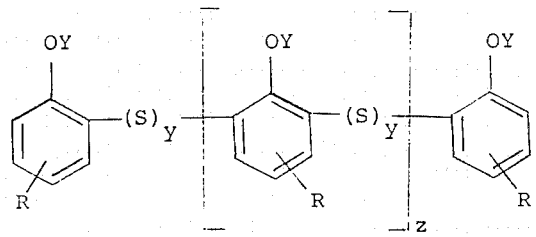

wherein R is an alkyl group having from 8 to 35 carbons; $y$ is an integer from 1 to 5; $z$ is an integer from 0 to 15; Y is the same or different constituent selected from H or ½-M where the ratio of H to ½-M is proportional to the molar ratio of M to alkylphenol reacted; and M is an alkaline earth metal.

The above formula represents a broad and simplified version of the sulfurized compounds and it should be recognized that minor amounts of compounds not defined by the above equation may be present in the reaction product mixture. The mutual solvent employed in the above reaction can comprise any stable organic liquid having appreciable solubility for both the alkaline earth metal base and alkylphenol. Exemplary solvents include ethylene glycol, 1,4-butanediol, etc.

BISPHOSPHORAMIDE

Another component of the lubricant composition of this invention is a bisphosphoramide. Bisphosphoramides are prepared by reacting (1) phosphorus oxychloride with (2) a polyamine having from 2 to 7 amine nitrogens, from 2 to 20 carbons and having at least 1 primary amino group and (3) a monoamine having from 1 to 40 carbons. The preferred bisphosphoramides are prepared by reacting phosphorus oxychloride with a polyamine having from 2 to 3 amine nitrogens and from 2 to 25 carbons (more preferably from 10 to 24 carbons) and having at least 1 primary amino group. Most preferably, the polyamine is a diamine having one secondary amino group and one primary amino group.

The reaction can be conducted non-catalytically by merely contacting the three reactants within a suitable reaction vessel at a temperature ranging from 0° to 200° C and preferably from 20° to 150° C. The reaction pressure is not critical, except that it is preferred to apply sufficient pressure on the system to maintain liquid-phase conditions. Generally, the pressure ranges from 10 to 500 psia and preferably from 14 to 35 psia.

The preferred polyamines which may be employed to prepare the bisphosphoramides have the following general formula:

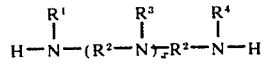

wherein $x$ is an integer from 0 to 5, $R^1$ is hydrogen or a $C_1$-$C_{24}$ hydrocarbyl; $R^2$ is a $C_2$-$C_{10}$ hydrocarbylene; $R^3$ is the same or different substituent selected from hydrogen or a $C_1$-$C_6$ hydrocarbyl; and $R^4$ is selected from (i) hydrogen or (ii) a $C_1$-$C_{24}$ hydrocarbyl when $R^1$ is hydrogen.

As referred to herein, hydrocarbyl is a monovalent organic radical composed essentially of hydrogen and carbon and may be aliphatic, aromatic, or alicyclic or combinations thereof, e.g., aralkyl, alkyl, aryl, cycloalkyl, alkylcycloalkyl, etc., and may be saturated or ethylenically unsaturated (one or more double-bonded carbons conjugated or non-conjugated). The preferred hydrocarbyl is an alkyl. The hydrocarbylene as defined herein, is a divalent hydrocarbon radical which may be aliphatic, alicyclic, aromatic or combinations thereof, e.g., alkylene, arylene, alkylarylene, aralkylene, alkylcycloalkylene, cycloalkylarylene, etc., having two free valences on different carbon atoms. The preferred hydrocarbylene is an alkylene.

Exemplary polyamines which may be employed in the process of this invention include the following: N-phenylethylenediamine, N-ethyl-o-tolidine, N'-ethyl-1,3-propanediamine, ethylenediamine, N-allylethylenediamine, N-laurylethylenediamine, N,N'-diethyldiethylenetriamine, N-allyl-1,3-propanediamine, N-octadecylethylenediamine, N-octadecyldiethylenetriamine, etc.

Exemplary monoamines which may be employed in the practice of this invention include primary alkylamines such as heptylamine, octylamine, dodecylamine, tetradecylamine, hexadecylamine, octadecylamine, etc.; secondary alkylamines such as diheptylamine, N-ethyl-N-hexylamine, N-hexyl-N-octylamine, dioctylamine, N-butyl-N-hexylamine, etc.; primary and secondary cycloalkyl- and alkylcycloalkylamines such as 2-ethylcyclohexylamine, N-ethyl-N-cyclohexylamine, N-methyl-N-cyclohexylamine, N-propyl-N-cyclohexylamine, N-ethyl-N-cyclopentylamine, 2-propyl-3-ethylcyclohexylamine, etc.; and primary and secondary aryl- and alkylarylamines such as methylaniline, toluidine, N-ethyl-N-phenylamine, nitroaniline, diphenylamines, N,N-propylphenylamine, 2,4,6-trichloroaniline, N-octyl-N-phenylamine, etc.

Preferred monoamines are the $C_{10}$-$C_{40}$ primary and secondary vegetable oil amines such as caprylamine, dicaprylamine, laurylamine, dilaurylamine, myristylamine, dimyristylamine, palmitylamine, dipalmitylamine, etc., and mixtures thereof. Particularly preferred monoamines are prepared from vegetable oils and fats such as coconut oil, corn oil, rape oil, castor oil, peanut oil, cottonseed oil, linseed oil, olive oil, palm oil, safflower oil, soybean oil, sperm oil, tung oil, etc. These oils are generally comprised of a mixture of saturated and unsaturated fatty acids such as capric, caprylic, lauric, myristic, palmitic, stearic, oleic, ricinoleic, linoleic, etc. Fatty acids are converted into the corresponding primary or secondary amines by conventional processing means.

Bisphosphoramides may be prepared by either a batch or continuous processing scheme. In a typical batch process, a reaction vessel, preferably constructed or lined with a corrosive-resistant material, is charged with a suitable inert reaction solvent and the polyamine and monoamine. The contents of the reactor are stirred to disperse the reactants within the reaction solvent. Phosphorus oxychloride is then introduced into the reaction vessel in contact with the other reactants. The reaction takes place spontaneously upon the contacting the reactants to produce the bisphosphoramide. Since the reaction is also exothermic, care must be taken in the introduction of the reactants in order to avoid rapid increase in localized temperatures. Preferably, the phosphorus reactant is introduced into the vessel at a rate of 5 to 25 molar parts per 50 molar parts of polyamine and monoamine per hour. This addition rate is not critical for the practice of this invention and only provides a convenient method of introducing the phosphorus reactant into the system without harmful increases in localized temperatures. In another alternative embodiment, the reactants may be charged to the vessel in an intermittent manner.

During the course of the reaction, hydrogen chloride is released as a by-product. This by-product can be stripped from the reaction medium during or after the completion of the reaction. While stripping may be a convenient method for removing the material, the conditions employed during the stripping steps in many instances have an adverse effect on the bisphosphoramide product. Therefore, it is preferred to complex or neutralize the hydrogen chloride within the reaction medium simultaneously with its formation. I have found that the complexing or neutralization step can be accomplished by admixing a stable basic compound or acid acceptor within the reaction medium. Exemplary acid acceptors include $C_1$-$C_{20}$ trialkylamines such as trimethylamine, triethylamine, tripropylamine, triisopropylamine, tributylamine, etc., basic hetarenes such as pyridines, quinoline, picoline, pyrazine, etc., as well as basic metal compounds such as alkaline earth metal hydroxides and alkali metal hydroxides. Also, metal carbonates and bicarbonates may be employed.

The preferred acid acceptors are the trialkylamines and hetarenes, since water is not produced in the neutralization of the hydrogen chloride by-product. The presence of water in the system is to avoided since it may react with the phosphorus oxychloride reactant.

The bisphosphoramide may then be filtered to remove the liquid reaction medium and unreacted reactants. Although filtering is preferred, it is recognized that alternative purification steps can be performed such as extraction, stripping, etc.

As discussed supra, the reaction is preferably conducted in the presence of an inert, stable reaction solvent. Exemplary reaction solvents which may be employed in the practice of this invention include $C_5$-$C_{20}$ aliphatic or aromatic hydrocarbons such as hexane, octane, nonane, benzene, toluene, methylnaphthalene, ethylcyclohexane, etc., halogenated hydrocarbons, hydrocarbon esters, hydrocarbon ethers, etc.

The concentration of the various reactants within the reaction medium can vary over a wide range depending upon the reactants chosen, the reaction conditions, vessel construction, processing scheme, etc. Generally, however, the reactants will be present in the amount shown in the following Table I.

TABLE I

| Component | Broad Range, Wt.% | Preferred Range, Wt.% |
|---|---|---|
| Reaction solvent | 40–80 | 60–70 |
| Polyamine | 1–20 | 2–10 |
| Monoamine | 10–50 | 20–40 |
| Acid Acceptor | 5–30 | 10–20 |
| Phosphorus Oxychloride* | 4–15 | 6–10 |

* Based on the amount introduced into the reaction medium

The molar ratio of reactants introduced into the reaction medium will generally vary from 1 to 3 molar parts of monoamine and 0.4 to 0.6 molar part of polyamine per molar part of phosphorus oxychloride. Preferably, the reactants are present in substantially stoichiometric amounts, i.e., 4 molar parts monamine, 1 molar part of polyamine and 2 molar parts of phosphorus oxychloride.

The lubricant composition is prepared by simply admixing, through conventional dispersing techniques, the appropriate amount of oil-soluble anti-oxidant and bisphosphoramide within the suitable lubricating oil. The selection of the particular base oil, anti-oxidant and bisphosphoramide as well as the amounts and ratios of each, depends upon the concentrated application of the lubricant and the presence of other additives. Generally, however, the amount of oil-soluble anti-oxidant employed in the lubricating oil will vary from 0.05 to 10 weight percent, usually from 0.1 to 5 weight percent, based on the weight of the final composition. The ratio of oil-soluble anti-oxidant to bisphosphoramide will generally vary from 0.1 to 20:1 and more usually between 1 to 10:1.

The lubricating oil which may be employed in the practice of this invention includes a wide variety of hydrocarbon oils. Other oils include lubricating oils derived from coal products and synthetic oils, e.g., alkylene polymers (such as polypropylene, polybutylene, etc. and mixtures thereof) alkylene oxide-type polymers (e.g., alkylene oxide polymers prepared by polymerizing alkylene oxide such as ethylene oxide, propylene oxide etc., in the presence of water or alcohol, e.g., ethyl alcohol), carboxylic acid esters (e.g., those which were prepared by esterifying carboxylic acids such as adipic acid, azelaic acid, suberic acid, sebacic acid, alkenylsuccinic acid, fumaric acid, maleic acid, etc., with an alcohol such as butyl alcohol, hexyl alcohol, 2-ethylhexyl alcohol, pentaerythritol, etc.), liquid esters of phosphorus, such as trialkyl phosphate (tributyl phosphate), dialkylaryl phosphate, triaryl phosphate (tricresyl phosphate) etc., alkylbenzenes, polyphenyls (e.g., biphenyls and terphenyls), alkylbiphenyl ethers and esters; polymers of silicon, e.g., tetraethyl silicate, tetraisopropyl silicate, hexyl(4-methyl-2-pentoxy) disilicate, poly(methyl)siloxane and poly(methylphenyl) siloxane, etc. The lubricating oils may be used individually or in combinations whenever miscible or whenever made so by use of mutual solvents. The lubricating oils generally have a viscosity which ranges from 50 to 5000 SUS (Saybolt Universal Seconds) and usually from 100 to 1500 SUS at 100° F.

In addition to the oil-soluble anti-oxidant and the bisphosphoramide, other additives may be successfully employed within the lubricating composition of this invention without affecting its high stability and performance over a wide temperature scale. One type of additive which may be employed is a rust inhibitor. The rust inhibitor is employed in all types of lubricants to suppress the formation of rust on the surface of metallic parts. Exemplary rust inhibitors include sodium nitrite, alkenylsuccinic acids and derivatives thereof, alkylthio-acetic acid and derivatives thereof, substituted imidazoles, amine phosphates, etc.

Other types of lubricating oil additives which may be employed in the practice of this invention include anti-foam agents (e.g., silicones, organic copolymers), stabilizers, anti-stain agents, tackiness agents, anti-chatter agents, dropping-point improvers, anti-squawk agents, lubricating color correctors, extreme-pressure agents, odor-control agents, dispersants, detergents, anti-wear agents, such as tricresyl phosphate and zinc dithiophosphate esters, etc.

In many instances it may be advantageous to form concentrates of the oil-soluble anti-oxidant or mixture of anti-oxidants and the bisphosphoramide with or without a carrier liquid. The employment of concentrates provides a convenient method of handling and transporting the compounds for their subsequent dilution and use. The concentration of the two or more components within the concentrates may vary from 10 to 90 weight percent of oil-soluble anti-oxidant or anti-oxidants, 5 to 50 weight percent bisphosphoramide and 0 to 45 percent diluent oil, although it is preferred to maintain the concentration between about 40 to 90 weight percent anti-oxidant or mixed anti-oxidants, 10 to 30 weight percent bisphosphoramide and 0 to 21 weight percent diluent oil.

LUBRICANT PERFORMANCE

The presence of the bisphosphoramide within the lubricant composition promotes the properties of the oil-soluble anti-oxidants. With this combination, lower concentrations of the anti-oxidants are necessary in the lubricant to realize the desired anti-oxidation properties.

In addition to promoting the anti-oxidation properties, the bisphosphoramides impart significant anti-wear properties to the lubricant.

It should be well recognized that the anti-oxidant and bisphosphoramide mixture may be successfully employed in lubricant applications wherein oxidation or metal wear is a problem. Thus, the mixture may be employed in lubricating oil such as motor oils, turbine oils, gear oils, railroad diesel engine oils, tractor and truck diesel engine oils, two-cycle gasoline engine oils, cutting oils, drilling oils, lapping, grinding and honing oils, lubricating oils for pneumatic devices such as jack-hammers, sinkers, stoppers, drifters and downhole drills.

The oil-soluble anti-oxidant and bisphosphoramide mixture may also be useful in mist lubricants. In a mist lubricating system the lubricant is atomized in a mist generator and carried through conduits by an air stream. The lubricant droplets are coalesced and collected at the lubricant site. Such systems permit simultaneous lubrication of several remote lubrication points from a central lubricant reservoir.

The following examples are presented to illustrate the practice of specific embodiments of this invention and should not be interpreted as limitations upon the scope of this invention.

EXAMPLE 1

This example is presented to illustrate the preparation of a representative bisphosphoramide of this invention. A 4-liter resin flask equipped with a dropping funnel, gas tube, stirrer and thermometer is charged with 1212 g. of triethylamine, 1508 g. of dicocoamine and 278 g. of N-coco-1,3-propanediamine (Duomeen C). The contents of the flask are stirred and heated to a temperature of 50° C. The contents are cooled to 40° C and 306 g. of phosphorus oxychloride are slowly added to the mixture through the dropping funnel for a period of approximately 1 hour.

After the phosphorus oxychloride has been charged to the reactor, the contents are heated to a temperature of approximately 110° to 120° C for a period of about 6 hours. At the end of the reaction period the reactor contents are cooled and filtered to recover the filtrate. The filtrate is extracted 3 times with 2500 ml. of mixed hexanes and filtered. The filtrate is then washed with 2000 ml. of water and 1200 ml. of isopropyl alcohol. The filtrate is stripped at 150° C and the remaining residue is calculated to have the following average structural formula:

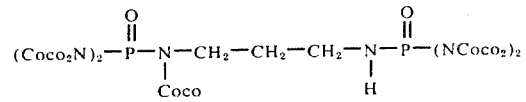

where Coco is a mixture of alkyl groups derived from coconut oil. Other compounds, such as $(Coco_2N)_3PO$, are also present.

An analysis of the compound reveals the following: nitrogen, calc. 4.48 weight percent, found 4.39 weight percent; phosphorus, calc. 3.3 weight percent, found 3.4 weight percent.

EXAMPLE 2

A 3-liter resin flank equipped with a stirrer, a nitrogen inlet tube, a thermometer and a dropping funnel is charged with 160 g of N-oleyl-1,3-diaminopropane (Duomeen 0), 264 g. of di(coco)amine (Armeen 2C), 162 g of triethylamine and 1110 ml of toluene. The contents of the flask are stirred and heated to a temperature of 50° C to uniformly disperse the dicocoamine and N-oleyl-1,3-diaminopropane within the toluene. Thereafter, 77.5 g. of phosphorus oxychloride is added to the mixture through the dropping funnel over a period of 2 hours at a temperature of 145° to 155° C. The contents are then heated and stirred at 90° C and then cooled to 50° C. The product is then filtered and the filtrate extracted twice with 600 ml. of toluene. The extracted filtrates are then washed with 700 ml. of water and 700 ml. of isopropanol. The filtrate is then stripped under 30 mm vacuum at 150° C and the remaining residue is thought to contain compounds of the following structural formulas:

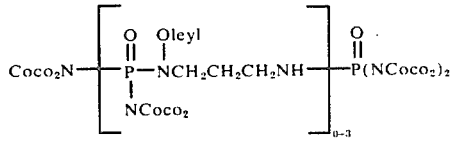

$(Coco_2N)_2POCl$, etc.

An analysis of the compound reveals 5.2% N.

EXAMPLE 3

This example is presented to illustrate the effectiveness of the combination of an anti-oxidant and a bisphosphoramide in suppressing oxidation over the use of either component individually. In addition, the compounds are subjected to the ASTM Four-Ball Wear Test and the anti-wear properties of the samples are determined.

The Oxidation Test as employed herein measures the resistance of the test samples to oxidation from pure oxygen with a Dornte-type oxygen absorption apparatus (R. W. Dornte "Oxidation of White Oils", *Industrial ɜ Engineering Chem.*, Vol. 28, p. 26, 1936). The conditions are atmosphere of pure oxygen exposed to the test oil maintained at a temperature of 340° F. The time required for 100 g. of test sample to remove 1000 ml. of oxygen is observed and reported in the following Table II. In order to simulate the oxidation occurring in an internal combustion engine, a mixture of various soluble metal-naphthenates, typifying the metal analysis frequently encountered in crankcase oils, is mixed with a sample oil in each test.

The Four-Ball Wear Test is ASTM Test D-2596 and is a measure of the anti-wear characteristics of the composition. In this test, three ½ inch steel balls of the type commonly used in ball bearings are placed in a steel cup and clamped in a fixed position. A fourth ball of the same type is held rigidly on the end of a shaft which rotates about a vertical axis. The balls are immersed in a test lubricant and the fourth ball is forced against the other three under a measured load. The fourth ball is then rotated at a designated speed for a fixed period. At the end of this period the wear scar diameters on the three fixed balls are measured and averaged. The average scar size is reported as results of the test. The smaller the wear scar, the better the anti-wear properties of the sample lubricant.

The experimental samples subjected to the above tests consist of the following: Sample A consists of the base oil formulation composed of a midcontinent petroleum neutral oil having a viscosity of 480 SUS at 38° C (100° F) and containing 6 weight percent of a conventional succinimide dispersant, 0.4 weight percent of a standard rust inhibitor, 0.05 weight percent of terephthalic acid, and 9 millimols of zinc dihydrocarbyl dithiophosphate. Test Sample B is the same as test Sample A except containing 1 weight percent of a sulfurized diparaffin containing 17.5 weight percent sulfur. Test Sample C is the same as test Sample B except including an additional 0.1 weight percent of a bisphosphoramide prepared by the method of Example 1. Test Sample D is composed of the base oil as defined in test Sample A plus 1 weight percent of a cross-sulfurized $C_{12}$-$C_{13}$ tallate and a cracked wax olefin wherein the total composition contains approximately 10.2 weight percent sulfur. Test Sample E is the same as test Sample D except containing 0.1 weight percent of the bisphosphoramide prepared by the method of Example 1. Test Sample F is the same as test Sample A except containing an additional 1 weight percent of a sulfurized ester containing approximately 20 weight percent sulfur. Test Sample G is the same as test Sample F except that an additional 0.1 weight percent of a bisphosphoramide of the type prepared by Example 1 is employed. Test Sample H is a 480 neutral oil. Test Sample I is the same as test Sample H except containing 1 weight percent of the bisphosphoramide prepared by the method of Example 1. Test Sample J is a 480 neutral oil containing 2 weight percent of a cross-sulfurized $C_{12}$-$C_{13}$ tallate and a cracked-wax olefin containing 10 weight percent sulfur and 0.2 weight percent of the bisphosphoramide prepared by the method of Example 1.

The results of the above samples in the Four-Ball Wear Test and Oxidation Test are presented in the following Table II.

TABLE II

| Sample No. | Bisphosphoramide Conc. (Wt.%) | Anti-Oxidant | Conc. (wt.%) | Oxidation Test (Hrs) | 4-Ball Wear(mm) |
|---|---|---|---|---|---|
| A | none | none | — | 0.5 | — |
| B | none | sulfurized olefin | 1 | 4.4 | — |
| C | 0.1 | sulfurized olefin | 1 | 7.3 | — |
| D | none | sulfurized ester-olefin | 1 | 5.8 | — |
| E | 0.1 | sulfurized ester-olefin | 1 | 5.6 | — |
| F | none | sulfurized ester | 1 | 5.6 | — |
| G | 0.1 | sulfurized ester | 1 | 6.4 | — |
| H | none | sulfurized ester-olefin | 6 | — | 0.40 |
| J | 0.2 | sulfurized ester-olefin | 6 | — | 0.32 |
| K | 0.5 | sulfurized ester-olefin | 6 | — | 0.26 |
| L | 1.0 | sulfurized ester-olefin | 6 | — | 0.29 |
| M | none | sulfurized ester-olefin | 2 | 2.8 | 0.36 |
| N | 0.2 | sulfurized ester-olefin | 2 | 5.4 | 0.26 |

EXAMPLE 4

Various lubricating oils containing the combination of an anti-oxidant and a bisphosphoramide are subjected to an oxidation test in this sample. The oxidation tests are conducted in the same manner as the oxidation test described in the previous example except that the catalyst is changed. In Oxidation Test A no catalyst is employed. In Oxidation Test C 2 ppm copper as copper naphthenate is employed. In Oxidation Test D, 20 ppm copper as the naphthenate is present. Varying amounts of phenolic, amine and sulfurized anti-oxidants are employed with varying amounts of the bisphosphoramide prepared by the method of Example 1. The results of this test are illustrated in the following Table III.

TABLE III

| Test No. | Type | Conc. (Wt.%) | Bisphosphoramide Conc. (Wt.%) | Oxidation Tests (Hrs.) A | C |
|---|---|---|---|---|---|
| 1 | None | — | none | 0.29 | 0.25 |
| 2 | Di-t-butyl-p-cresol | 0.5 | none | 7.3 | 8.6 |
| 3 | Sulfurized paraffin | 0.3 | none | 32 | 10 |
| 4 | Diisobornyl diphenylamine | 0.3 | none | 0.95 | 0.42 |
| 5 | None | — | 0.3 | 0.28 | 0.30 |
| 6 | Di-t-butyl-p-cresol | 0.5 | 0.3 | 6.6 | 7.9 |
| 7 | Sulfurized paraffin | 0.3 | 0.3 | 34 | 25 |
| 8 | Diisobornyl diphenylamine | 0.3 | 0.3 | 0.97 | 1.2 |
| 9 | Di-t-butyl-p-cresol<br>Sulfurized paraffin | 0.5<br>0.3 | none | 40 | 30 |
| 10 | Di-t-butyl-p-cresol<br>Sulfurized paraffin | 0.5<br>0.3 | 0.3 | 48 | 38 |
| 11 | Sulfurized paraffin<br>Diisobornyl diphenylamine | 0.3<br>0.3 | none | 42 | 39 |

TABLE III-continued

| Test No. | Type | Conc. (Wt.%) | Bisphosphoramide Conc. (Wt.%) | Oxidation Tests (Hrs.) A | C |
|---|---|---|---|---|---|
| 12 | Sulfurized paraffin<br>Diisobornyl diphenylamine | 0.3<br>0.3 | 0.3 | 52 | 48 |

What is claimed is:

1. In a composition of matter of improved antioxidant properties comprising a major amount of (1) an oil of lubricating viscosity, and (2) an oil-soluble anti-oxidant selected from (i) sterically hindered phenolic compounds wherein the sterically hindering groups are alkyl groups, said sterically hindered phenolic compounds having from 10 to 40 carbon atoms, (ii) aromatic amine compounds having from 12 to 40 carbons and from 1 to 3 amine nitrogens, (iii) sulfurized organic compounds containing 3 to 40 weight percent sulfur present as thio or polythio linkages or mixtures thereof, and (iv) mixtures thereof, the improvement comprising adding thereto (3) a bisphosphoramide prepared by reacting (a) phosphorus oxychloride, (b) a hydrocarbyl polyamine having from 2 to 7 amine nitrogens and from 2 to 20 carbons and having at least 1 primary amino group, and (c) a hydrocarbyl monoamine having from 2 to 40 carbons, wherein the molar ratio of monoamine and polyamine to molar part of phosphorus oxychloride is from 1 to 3 molar parts of monoamine and 0.4 to 0.6 molar parts of polyamine per molar part of phosphorus oxychloride, the ratio of said anti-oxidant to said bisphosphoramide being from 0.1 to 20:1.

2. The composition defined in claim 1 wherein said anti-oxidant is a phenolic anti-oxidant selected from sterically hindered monophenols, bisphenols, 4,4'-thiobisphenols, 4-hydroxy or 4-thiobenzoic acid esters and bis(4-hydroxy- or 4-thiolbenzoic acid mono- or dithio acid) alkylene esters.

3. The composition defined in claim 2 wherein said sterically hindered phenolic anti-oxidant has the formula:

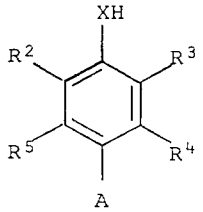

wherein X is sulfur or oxygen; $R^2$ and $R^3$ are alkyl groups which sterically hinder the XH group and have from 4 to 10 carbons; $R^4$ and $R^5$ are the same or different substituent selected from hydrogen or a $C_1$-$C_4$ alkyl; A is selected from hydrogen, a $C_1$-$C_{10}$ alkyl, a hindered phenol, 4,4'-thio hindered phenol, a $C_2$-$C_{21}$ ester, $C_2$-$C_{21}$ monothio or dithio ester, or a $C_2$-$C_{21}$ diester or $C_2$ to $C_{21}$ dithio ester group.

4. The composition defined in claim 1 wherein said anti-oxidant is an aromatic amine anti-oxidant selected from phenylamines, and phenylalkylamines.

5. The composition defined in claim 4 wherein said aromatic amine has the formula:

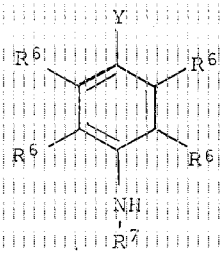

wherein $R^6$ is the same or different substituent selected from H, or a $C_1$-$C_4$ alkyl; $R^7$ is hydrogen or a $C_1$-$C_{18}$ alkyl, and Y is the same or different substituent selected from OH, SH, H, $R^6$ or $NHR^7$.

6. The composition defined in claim 1 wherein said oil-soluble anti-oxidant is a sulfurized organic compound selected from sulfurized $C_1$ to $C_{20}$ alkyl ester of a $C_8$ to $C_{24}$ fatty acid, sulfurized terpenes, sulfurized $C_8$ to $C_{30}$ aliphatic or aromatic hydrocarbons, amido-substituted dithiazolethiones, sulfurized hydroxy esters having from 10 to 20 carbons, polyalkylphenol sulfides or sulfurized alkaline earth metal phenates.

7. The composition defined in claim 6 wherein said sulfurized organic compound is present at a concentration of 0.5 to 10 weight percent and said bisphosphoramide is present at a concentration of 0.05 to 5 weight percent.

8. The composition defined in claim 7 wherein said sulfurized organic compound is a sulfurized $C_1$ to $C_{20}$ alkyl ester of a $C_8$ to $C_{24}$ fatty acid.

9. The composition defined in claim 7 wherein said oil has a viscosity of 50 to 5000 SUS at a temperature of 100° F.

10. The composition defined in claim 1 wherein a mixture of said oil-soluble anti-oxidants is employed.

11. In a composition of matter of improved antioxidant properties comprising from 0 to 45 weight percent of (1) an oil of lubricating viscosity, and (2) from 10 to 90 weight percent of an oil-soluble antioxidant selected from (i) sterically hindered phenolic compounds wherein the sterically hindering groups are alkyl groups, said sterically hindered phenolic compounds having from 10 to 40 carbon atoms, (ii) aromatic amine compounds having from 12 to 40 carbons and from 1 to 3 amine nitrogens, (iii) sulfurized organic compounds containing 3 to 40 weight percent sulfur present as thio or polythio linkages or mixtures thereof, and (iv) mixtures thereof, the improvement comprising adding thereto (3) from 5 to 50 weight percent of a bisphosphoramide prepared by reacting (a) phosphorus oxychloride, (b) a hydrocarbyl polyamine having from 2 to 7 amine nitrogens and from 2 to 20 carbons and having at least 1 primary amino group, and (c) a hydrocarbyl monoamine having from 2 to 40 carbons, wherein the molar ratio of monoamine and polyamine to molar part of phosphorus oxychloride is from 1 to 3 molar parts of monoamine and 0.4 to 0.6 molar parts of polyamine per molar part of phosphorus oxychoride, the ratio of said anti-oxidant to said bisphosphoramide being 0.1 to 20:1.

* * * * *